United States Patent [19]

Baudis et al.

[11] 4,441,930

[45] Apr. 10, 1984

[54] PROCESS FOR REMOVAL OF SAND MOLD RESIDUES FROM CAST PARTS

[75] Inventors: Ulrich Baudis, Hanau; Peter Biberbach, Rodenbach; Wolfgang Weber, Karlstein, all of Fed. Rep. of Germany

[73] Assignee: Degussa Aktiengesellschaft, Frankfurt, Fed. Rep. of Germany

[21] Appl. No.: 217,094

[22] Filed: Dec. 16, 1980

[30] Foreign Application Priority Data

Dec. 19, 1979 [DE] Fed. Rep. of Germany ..... 2951130

[51] Int. Cl.[3] ..... C03C 23/00

[52] U.S. Cl. ..... 134/2; 164/132

[58] Field of Search ..... 134/5, 41, 42, 2; 164/132

[56] References Cited

FOREIGN PATENT DOCUMENTS 800242 1/1981 U.S.S.R. ..... 134/42

*Primary Examiner*—Ferris H. Lander

*Attorney, Agent, or Firm*—Cushman, Darby & Cushman

[57] ABSTRACT

For removing and dissolving sand mold residues from cast parts, particularly sand mold residues containing zirconium oxide and titanium oxide, there have previously been used mechanical and electrochemical processes in salt melts. However, these processes are very expensive, attack the surface of the cast pieces or fail to work with sand mold constituents which are difficult to dissolve. These disadvantages are avoided by inserting the cast parts having adhering sand mold residues into a melt of 55 to 97 weight % of alkali metal hydroxide and 3 to 45 weight % of one or more fluorides of an element of the first to third main group of the periodic system of elements and/or zinc at 400° to 900° C. Preferably the salt melt additionally contains a boron-oxygen and/or a boron-fluorine compound.

13 Claims, No Drawings

PROCESS FOR REMOVAL OF SAND MOLD RESIDUES FROM CAST PARTS

BACKGROUND OF THE INVENTION

The present invention is directed to a process for removing and dissolving zirconium oxide and/or titanium oxide containing sand mold residues on cast parts in salt melts.

Complicatedly shaped structural parts for the construction of machines or apparatus are frequently produced of cast steel by means of precision casting processes. Besides the customary sand molds which usually consist of pure quartz or quartz-aluminum oxide mixtures, there are also used zirconium oxide, titanium oxide or other metal oxide for improving the accuracy of dimensions and for creating a clean, smooth surface in the production of the casting molds. Zirconium oxide containing molding sands have proven to be particularly good and are much used in the fine casting art.

Especially with complicated shaped cast parts there is the problem that after breaking of the casting mold into pieces residues to the molding sand still adhere very firmly to the surface of the embedded cast piece and especially can only be removed with difficulty from hollow spaces, complex shaped cavities or bores.

To remove this molding sand in the compressed state, one skilled in the art normally uses mechanical and chemical cleansing processes.

Generally molding sand residues are preliminarily cleansed with hammer and chisel, with Widia-borers, by scraping, abrading or scouring by hand, the final cleansing takes place after that usually by repeated sand or ball blasting or using different types of blasting processes (centrifugal blasting, wet cleaning) or blasting medium (steel shot blasting). These mechanical processes have several disadvantages. They produce high operating costs, since they require a lot of work and pay for the workers and they have health risks since there is a danger of silicosis. As further disadvantages mention is made of the high wear and tear on the work tools (e.g. Widia borers, grinding wheels, etc.) and the high waste which particularly arises through rounding off the edges in the blasting process. Besides especially complicated sand mold particles generally cannot be removed mechanically under certain circumstances.

Where the employment of mechanically cleansing methods fail to work, e.g. in deep hollow spaces, bent or very fine bores, etc. chemical methods are used.

Additionally, the cast parts are frequently treated over many hours, indeed days, in hot aqueous sodium hydroxide or with aqueous hydrofluoric acid (e.g. Giesserei 66(1979), 406 or Fonderie 227 (1965) 29).

Furthermore, there are known processes in which the cast pieces to be cleansed are dipped in salt melts and desnaded electrochemically (Werkstoff und Betrieb 107(1974)101).

The known chemical methods fail to work particularly if there are included difficultly soluble chemical inert metal oxides such as zirconium oxide or titanium oxide in the molding sand. Such molding sands, however, are precisely those frequently used in precision casting. One is then generally completely directed to the mechanical cleansing.

The previously used cleansing processes in the casting art therefore are indicated in the technical literature as in general still needing great improvement.

Therefore it was the problem of the present invention to find a process for removal of sand mold residues, particularly those containing zirconium oxide (zirconium dioxide) and/or titanium oxide (titanium dioxide), on cast parts in salt melts with which there can be removed even difficulty soluble, chemically inert metal oxides without applying an electrical current.

SUMMARY OF THE INVENTION

This problem was solved according to the invention by inserting the cast parts having adhering molding sand residues in a melt of 55–97% weight % of alkali metal hydroxide (e.g. sodium hydroxide, potassium hydroxide or lithium hydroxide) and 3 to 45 weight % of one or more fluorides of the metallic elements of the first to third main groups of the periodic system of the elements and/or zinc and treating at a temperature of 400° to 900° C. Examples of such fluorides include sodium fluoride, potassium fluoride, lithium fluoride, calcium fluoride, barium fluoride, magnesium fluoride, strontium fluoride, aluminum fluoride, gallium fluoride or zinc fluoride. Advantageously there is additionally added to the melt a boron-oxygen containing compound and/or boron-fluorine containing compound wherein above all the additives used can be an alkali metal and/or alkaline earth borate, e.g. sodium metaborate, sodium orthoborate, sodium tetraborate, potassium metaborate, potassium tetraborate, lithium metaborate, lithium tetraborate, calcium metaborate, calcium tetraborate, magnesium metaborate, magnesium orthoborate, strontium tetraborate, iron borate, zinc borate (e.g. zinc metaborate), boric acid, boron oxide, boron trifluoride or an alkali metal hydroxyborate of the general formula $M[B(OH_{4-x}F_x]$ where M is Li, Na or K and x is 1,2,3. Particularly proven effective are salt melts which contain sodium hydroxide, sodium fluoride and water free borax in the weight ratio 3:1:1 at a temperature of 650° to 750° C., or 80 to 95 weight % sodium hydroxide 5 to 20 weight % calcium and/or barium fluoride and up to 10 weight % borax, e.g. to 10% borax.

The process of the invention avoids the problems mentioned in connection with the state of the art and in a short time leads to an outstanding cleaning of the cast parts. There have been shown to be a number of industrial and economic advantages.

Thus there are eliminated the troublesome mechanical cleaning by boring out, abrading, scraping etc. The disadvantages connected therewith, such as high wear and tear on the work tools and danger of silicosis are avoided. In the cleansing in the salt melt there appears the true, genuine surfaces of the cast parts. No rounding off of the edges and corners or removal of surface material takes place as perchance with sand blasting. The undesired casting skin of ferrosilicate in contrast is loosened.

Even very complicatedly shaped cast parts, in which the mechanical cleaning is particularly expensive, time consuming or even impossible, can be quickly and quantitatively cleaned. While zirconium oxide containing molding sands in the previously customarily used salt melts, such as alkali hydroxide mixtures or hydroxide-nitrate mixtures are as good as insoluble even with long times of treatment, the melts of the invention guarantee a quick and residue free elimination of the molding sand residues.

Surprisingly it was found that neither hydroxide, fluoride or borate melts by themselves are suited for dissolving zirconium dioxide or titanium dioxide containing molding sands but only the combination of two, or better, all three components in specific weight ratios cause this and lead to an optimum dissolving capacity with only slight corrosion attack on the steel casting. A mixture of alkali hydroxide and a fluoride is suited to dissolve and remove the sand mold residues at 400° to 800° C. Furthermore, the addition of a boron-oxygen containing compound causes a reduction of the corrosion attack and considerably strengthens the dissolving ability so that the cast parts can be withdrawn from the bath cleansed and metallically bright after a duration of treatment of 10–60 minutes. With pure hydroxide-fluoride melts calcium fluoride has proven particularly good.

Unless otherwise indicated all parts and percentages are by weight.

The process can comprise, consist essentially of or consist of the steps set forth with the stated materials.

The following examples further explain the process of the invention.

DETAILED DESCRIPTION

Example 1

30 kg of salt consisting of 18 kg of sodium hydroxide, 6 kg of water free borax and 6 kg of sodium fluoride were melted in a 22 cm diameter crucible consisting of a Ni-Cr-Fe alloy. The temperature was adjusted to 700° C. The precision cast parts coarsely freed mechanically from zirconium dioxide containing molding sand were filled into a loading basket or an iron loading rack, this was carried into the melt by means of a lifting jack. The temperature of the melt was held constant at 700° C. At once there began an exothermic digestion reaction whereby with light foaming of the melt the molding sand residues were removed from the casting. Generally treatment times of 10–30 minutes duration suffice, only in extreme cases are treatment times up to 60 minutes needed. After the end of the reaction the parts were completely freed from molding sand. The charge was withdrawn from the melt by means of a lifting jack, carried over a water chilled quenching tank and quenched there. The thus treated cast parts were metallically bright and completely cleansed of molding sand.

Example 2

9.5 kg of sodium hydroxide and 0.5 kg of calcium fluoride were melted together in an iron crucible having a diameter of 18 cm and 30 cm deep. The melt at 750° C. showed a good dissolving ability for the molding sand in an analogous procedure to that in Example 1. The average treating time was 1 to 2 hours.

Example 3

There were introduced into 6 kg of molten sodium hydroxide in a nickel crucible having a diameter of 18 cm and a depth of 30 cm, 1 kg of NaF, 0.5 kg of $ZnF_2$ and 1 kg of sodium ortho borate. The melt showed a good dissolving ability for the molding sand.

Example 4

There were melted in a low carbon steel crucible having a volume of 16 liters 5 kg of NaOH, 1 kg of KOH, 0.5 kg of $Na_3AlF_6$, 1 kg of NaF, 0.5 kg of $CaF_2$ and 1 kg of sodium metaborate. The thus produced melt at 700° C. had good dissolving ability for a zirconium dioxide containing molding sand, the cryolite addition in particular caused a quick digestion of the $Al_2O_3$ component.

Example 5

There were melted in a nickel crucible 8.5 kg of NaOH, 0.5 kg of $CaF_2$, 0.5 kg of $BaF_2$ and 0.5 kg of borax. This melt is very well suited for dissolving zirconium dioxide and titanium dioxide molding sand residues at 700° C.

The entire disclosure of German priority application No. P 2951130.6 is hereby incorporated by reference.

What is claimed is:

1. A process for removing and dissolving molding sand residues from cast parts in salt melts comprising inserting a cast part having molding sand residues in a melt consisting essentially of 55 to 97 weight % of alkali metal hydroxide and 3 to 45 weight % of at least one fluoride of a metallic element of the first to third main group of the periodic system of the elements and/or of zinc and also containing, based on the total weight of the above-mentioned melt, a boron containing compound which is a boron-oxygen compound or a boron-fluorine compound or a mixture thereof in an amount of from 1 to 40% by weight, and inserting the cast part in the melt at a temperature of 400° to 800° C.

2. The process of claim 1 wherein the temperature of the melt is 400° to 800° C.

3. The process according to claim 2, characterized in that the salt melt contains from 80 to 95% of sodium hydroxide, from 5 to 20% by weight of calcium fluoride, barium fluoride or a mixture of calcium fluoride and barium fluoride and borax, the borax being present in an amount up to 10% by weight.

4. The process of claim 3 wherein the molding sand contains zirconium dioxide, titanium dioxide or a mixture thereof.

5. The process of claim 2 wherein the molding sand contains zirconium dioxide, titanium dioxide or a mixture thereof.

6. The process of claim 5 wherein the alkali metal hydroxide is sodium hydroxide, potassium hydroxide or lithium hydroxide and the fluoride is a fluoride of sodium, potassium, lithium, calcium, magnesium, barium, aluminum or zinc.

7. The process of claim 6 wherein the alkali metal hydroxide is sodium hydroxide and the fluoride is a fluoride of sodium, calcium, barium or zinc.

8. The process of claim 5 wherein the boron containing compound is an alkali metal borate, an alkaline earth metal borate, iron borate, zinc borate, boric acid, boron trifluoride or an alkali metal hydroxyfluoborate of the formula $M[B(OH)_{4-x}F_x]$ where M is Li, Na or K and x is 1–3.

9. The process of claim 8 wherein the boron containing compound is sodium meta borate, sodium ortho borate, borax, iron borate, zinc borate, boric acid, boron trifluoride or an alkali hydroxyborate of the formula $M[B(OH)_{4-x}F_x]$.

10. The process of claim 9 wherein there is employed (a) sodium hydroxide, (b) sodium fluoride and (c) water free borax.

11. The process of claim 10 wherein the weight ratio of (a), (b) and (c) is 3:1:1 and the melt is held at a temperature of 650°–750° C.

12. The process of claim 9 wherein the salt melt contains 80 to 95 weight % sodium hydroxide, 5 to 20 weight % of calcium fluoride, barium fluoride or a mixture thereof and up to 10 weight % of borax.

13. The process of claim 12 wherein the borax is present in an amount of 5 to 10 weight %.

* * * * *